US006217363B1

(12) United States Patent
Takata

(10) Patent No.: US 6,217,363 B1
(45) Date of Patent: Apr. 17, 2001

(54) CONNECTOR AND CONNECTOR ATTACHMENT STRUCTURE

(75) Inventor: Kensaku Takata, Nagoya (JP)

(73) Assignees: Harness System Technologies Research, Ltd., Nagoya; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/337,464

(22) Filed: Jun. 21, 1999

(30) Foreign Application Priority Data

| | | |
|---|---|---|
| Jun. 26, 1998 | (JP) | 10-180863 |
| Aug. 27, 1998 | (JP) | 10-242040 |
| Sep. 1, 1998 | (JP) | 10-247581 |
| Jan. 25, 1999 | (JP) | 11-016240 |

(51) Int. Cl.[7] ..... H01R 4/50

(52) U.S. Cl. ..... 439/342; 439/247; 439/248; 439/354; 439/34

(58) Field of Search ..... 439/342, 34, 247, 439/248, 372, 152, 157, 164, 310, 567

(56) References Cited

U.S. PATENT DOCUMENTS

| | | | | |
|---|---|---|---|---|
| 4,824,387 | * | 4/1989 | DeJong et al. | 439/248 |
| 5,709,556 | * | 1/1998 | Tan et al. | 439/79 |
| 5,785,546 | * | 7/1998 | Hamai et al. | 439/354 |
| 5,848,902 | * | 12/1998 | Yamaguchi et al. | 439/34 |
| 5,893,768 | * | 4/1999 | Gawron et al. | 439/248 |
| 5,975,929 | * | 11/1999 | Matsuura et al. | 439/157 |

FOREIGN PATENT DOCUMENTS 5-54933 3/1993 (JP) .

* cited by examiner

*Primary Examiner*—Paula Bradley
*Assistant Examiner*—Alexander Gilman
(74) *Attorney, Agent, or Firm*—Oliff & Berridge, PLC

(57) ABSTRACT

A connector includes a first connector fixed to a first attachment member in a first direction, a holder fixed on a second attachment member, a second connector supported on said holder in a second direction which is opposite to said first direction, wherein said second connector is advanced in the second direction so as to connect with said first connector when said first attachment member and second attachment member are relatively approached.

18 Claims, 21 Drawing Sheets

Figure 1:
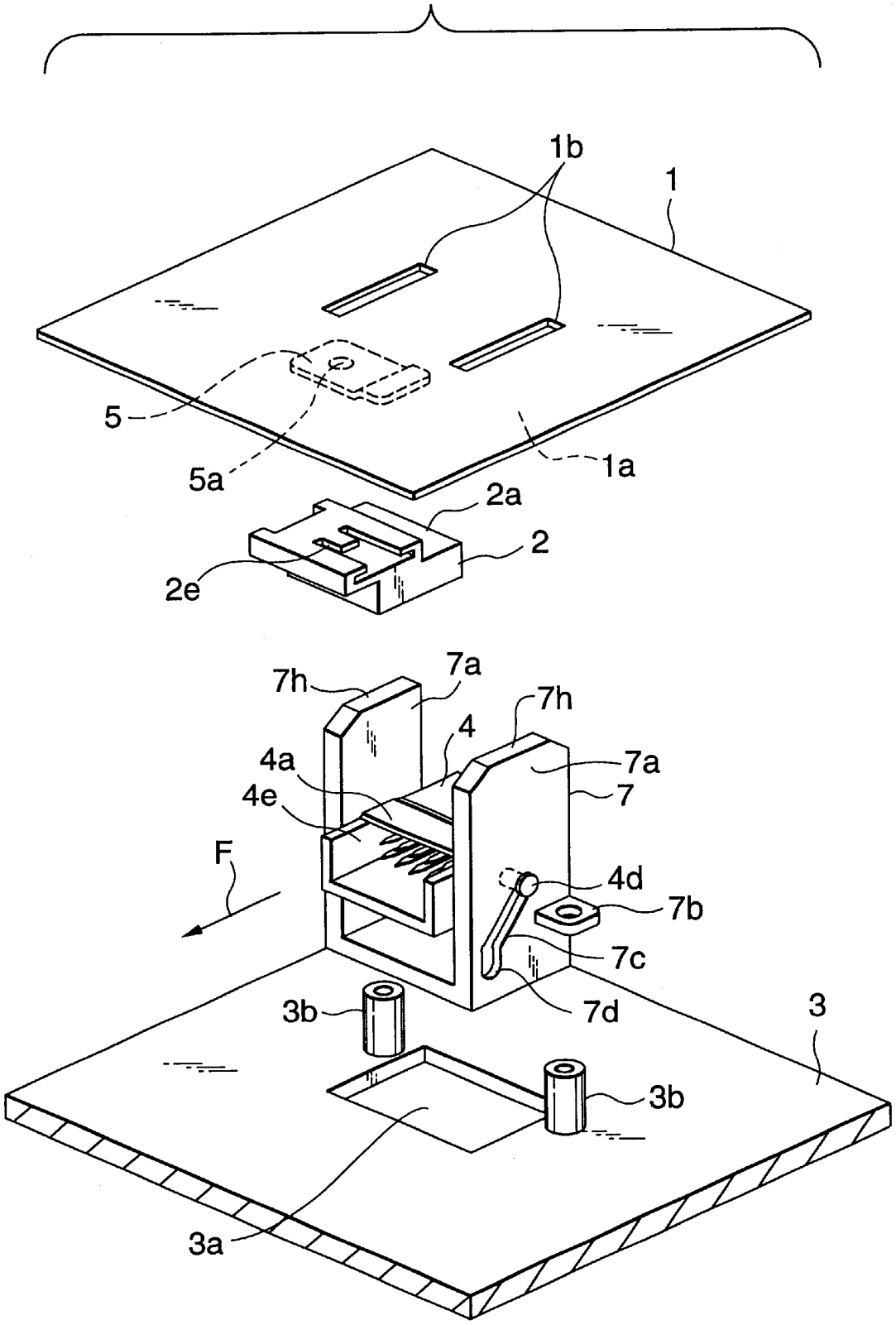
Figure 2A:
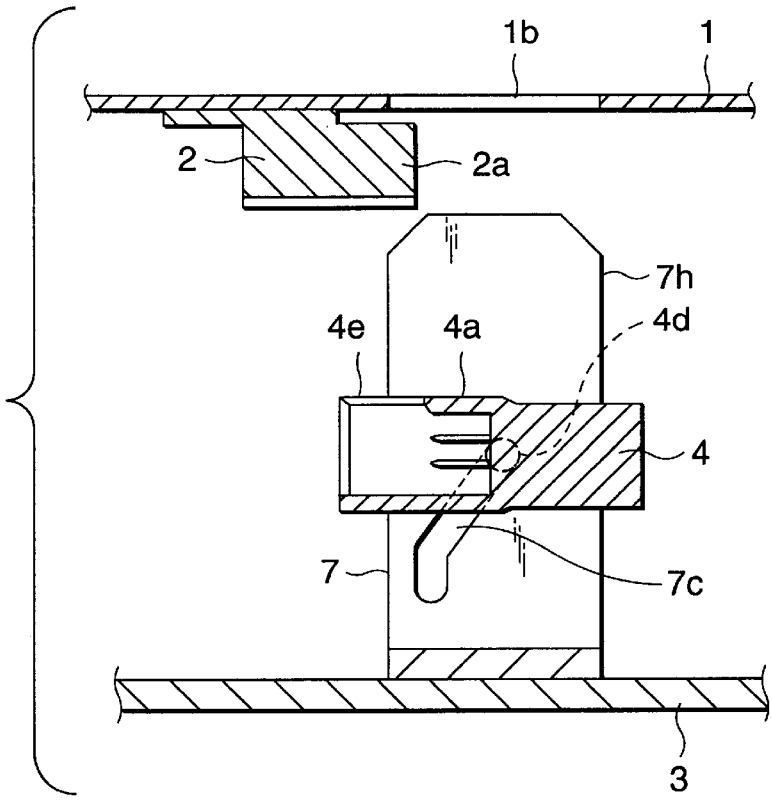
Figure 2B:
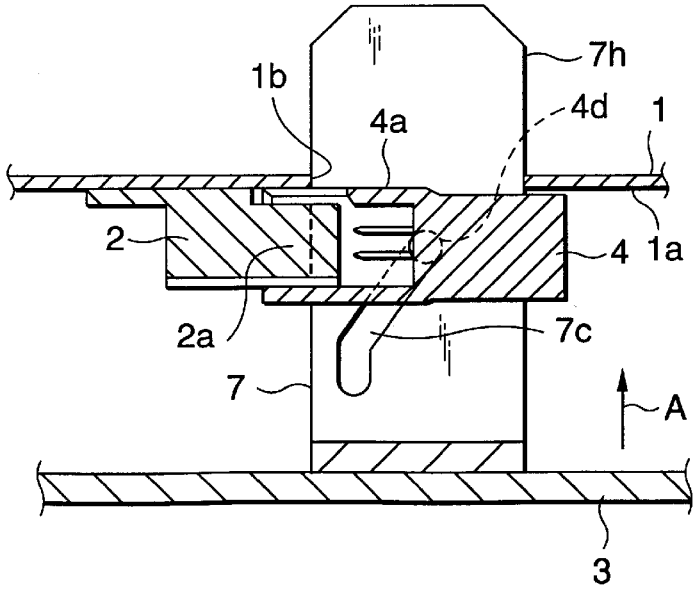
Figure 3A:
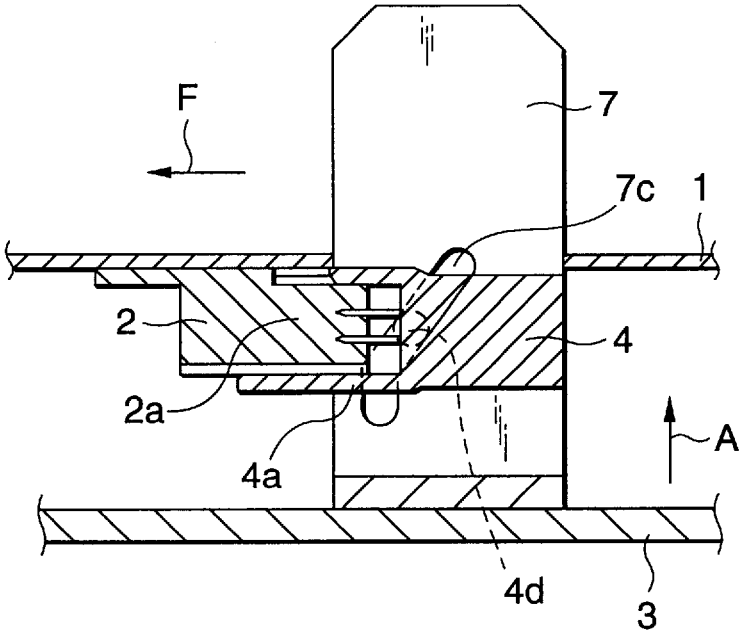
Figure 3B:
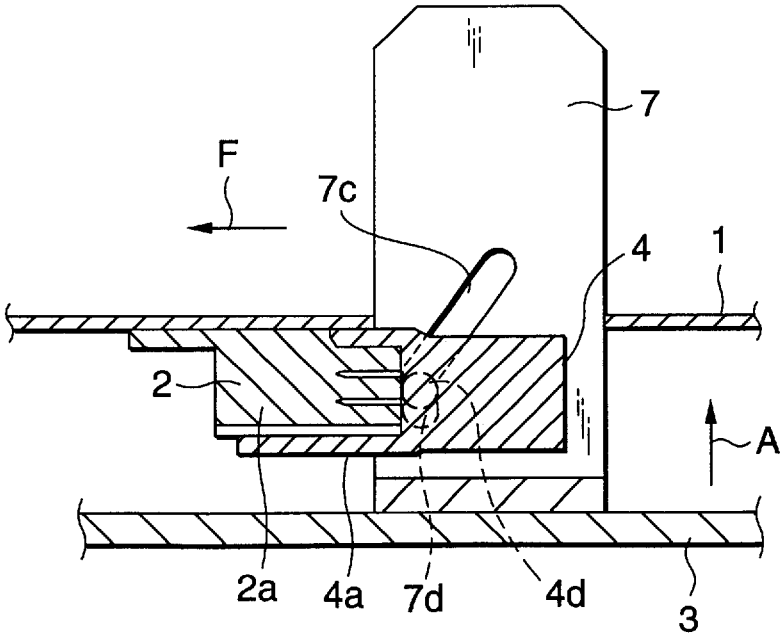
Figure 4A:
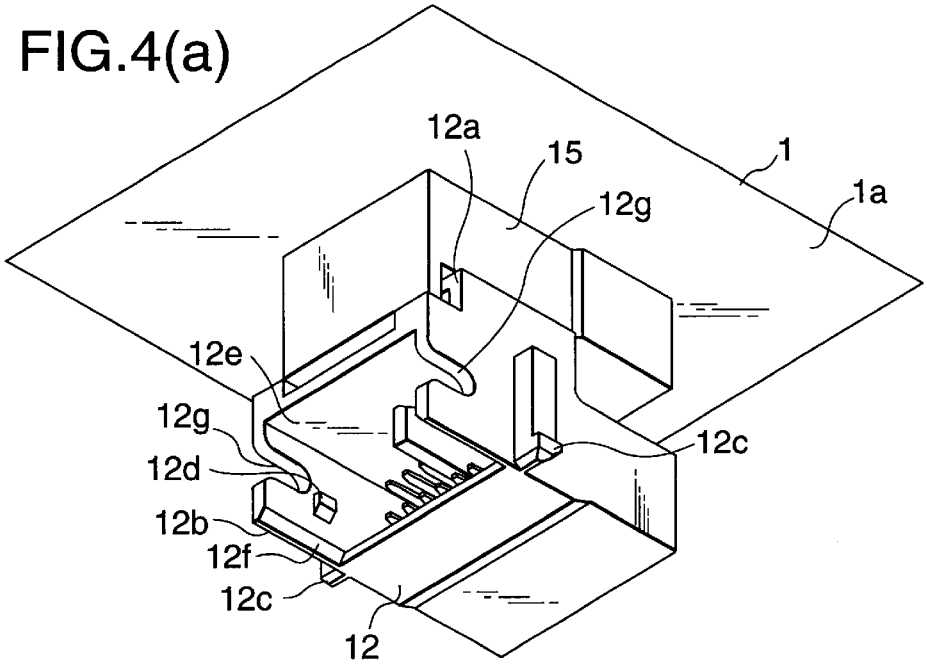
Figure 4B:
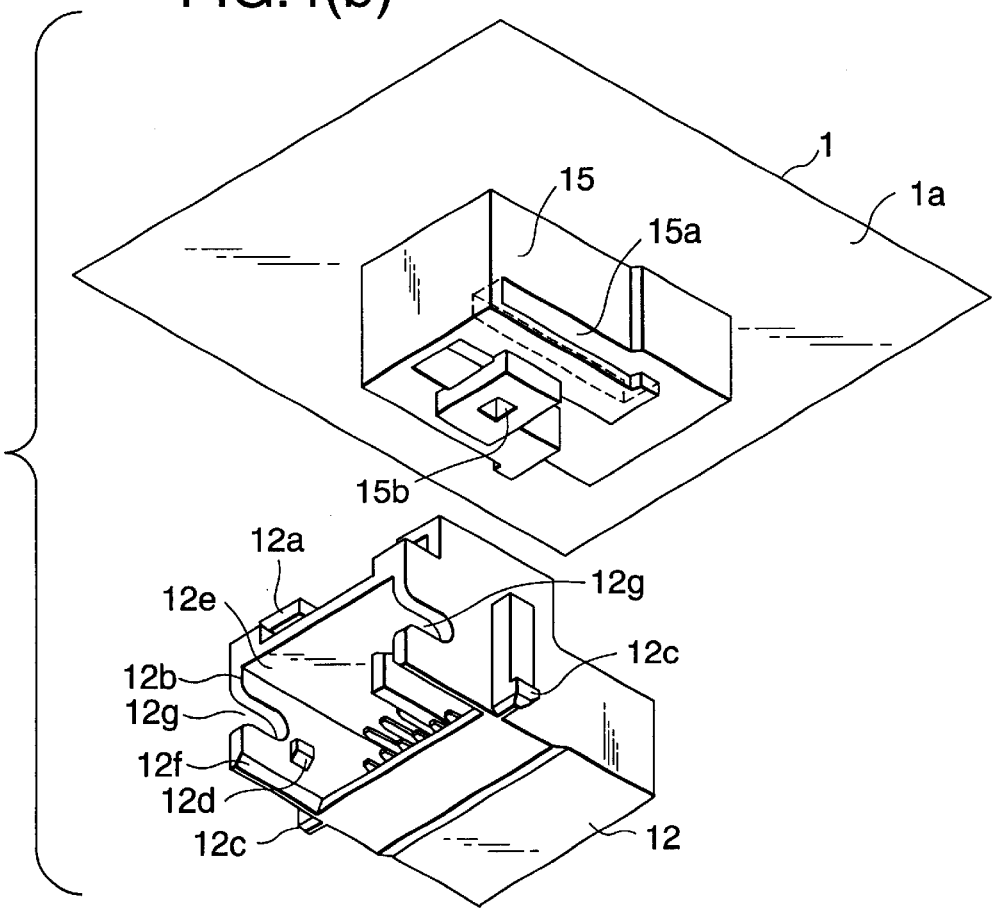
Figure 5A:
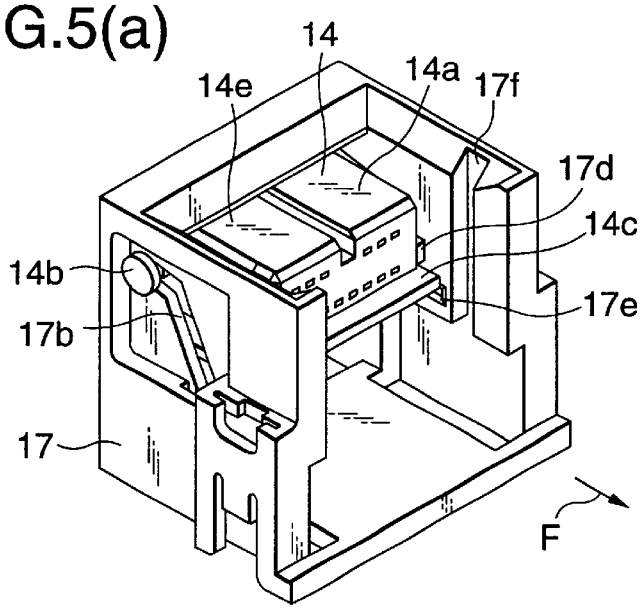
Figure 5B:
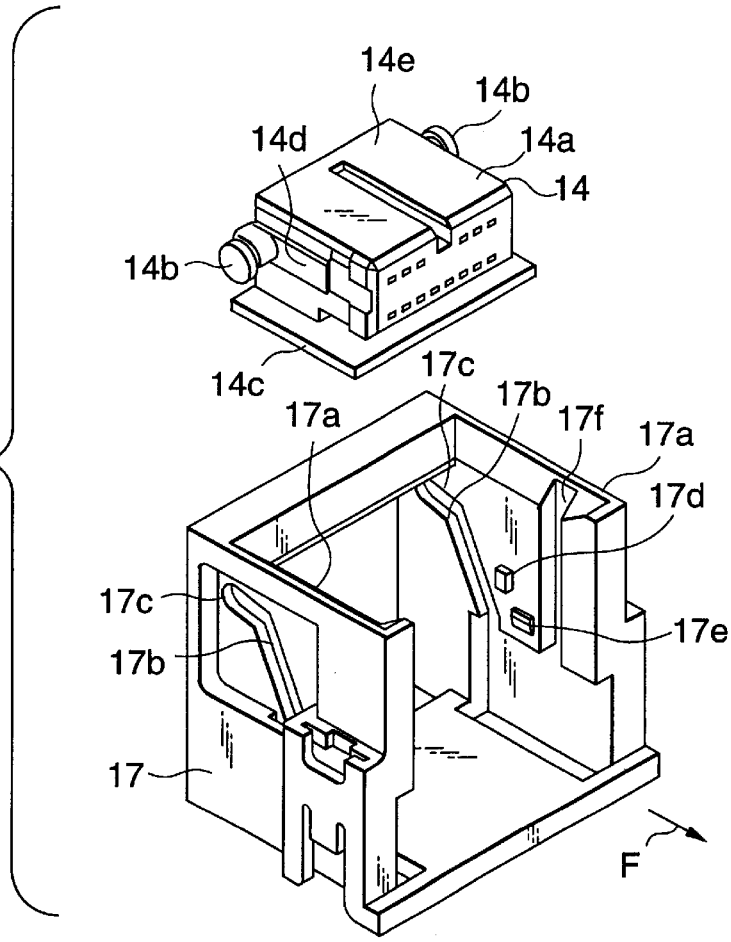
Figure 6A:
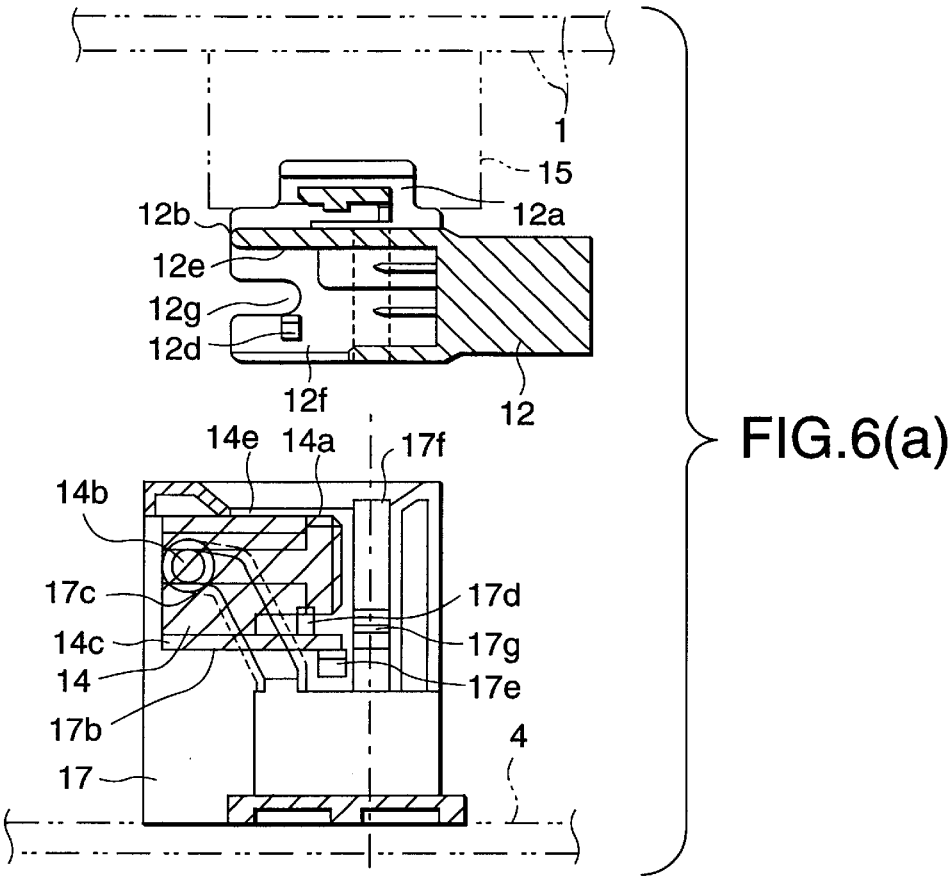
Figure 6B:
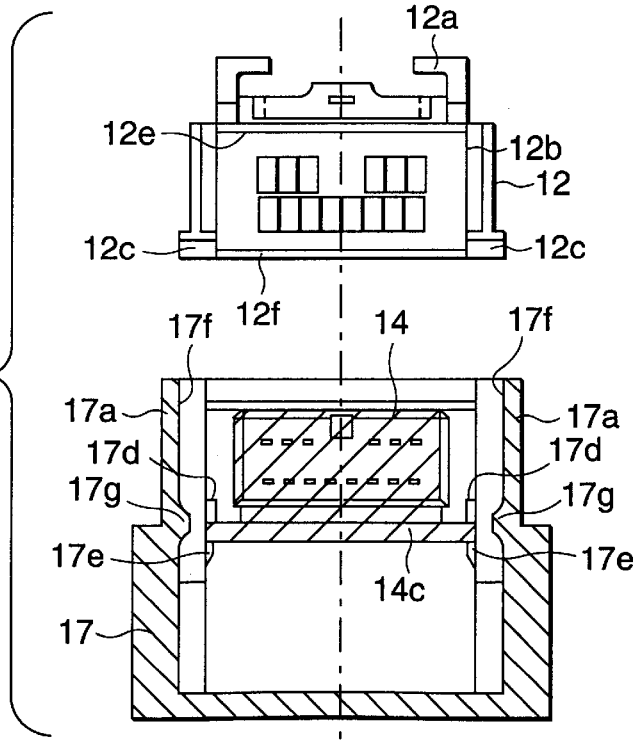
Figure 7A:
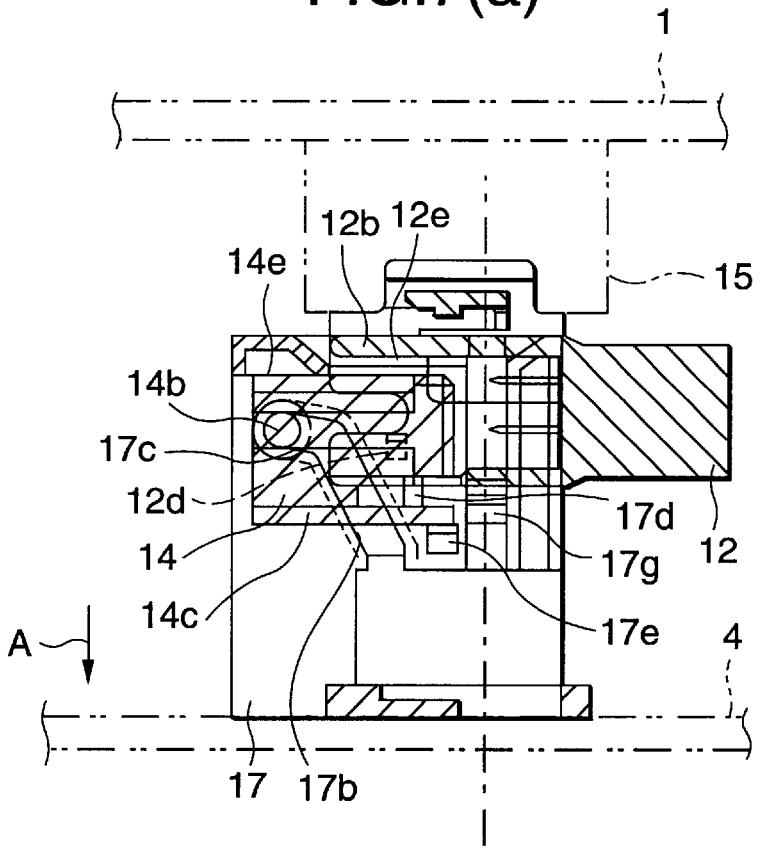
Figure 7B:
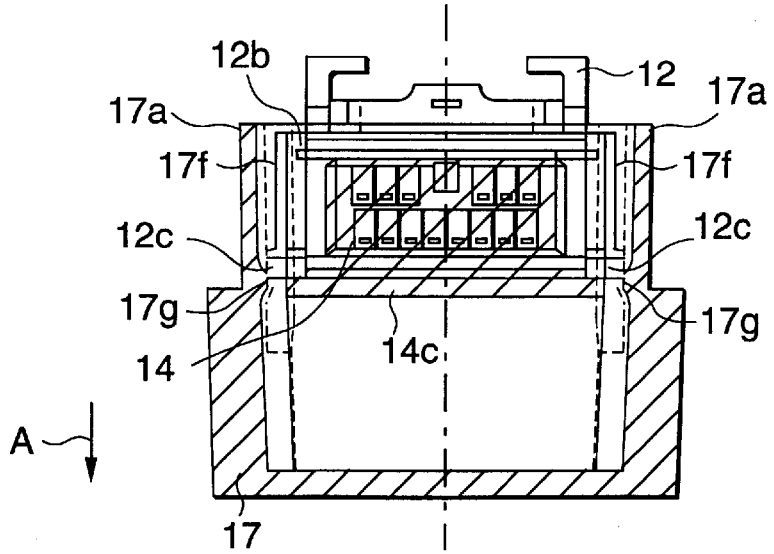
Figure 8A:
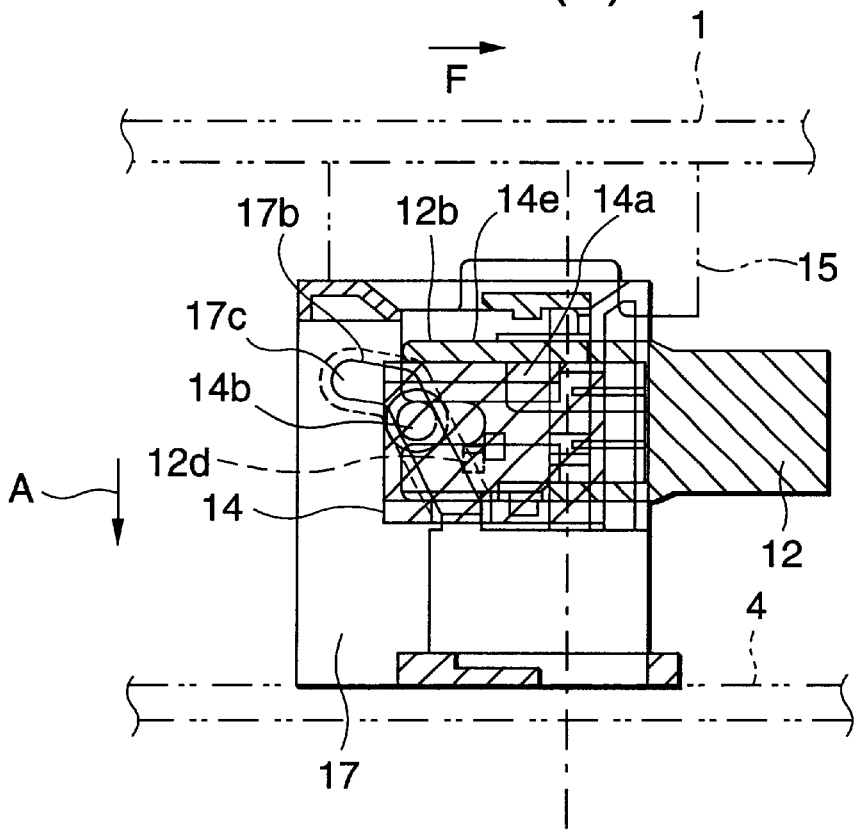
Figure 8B:
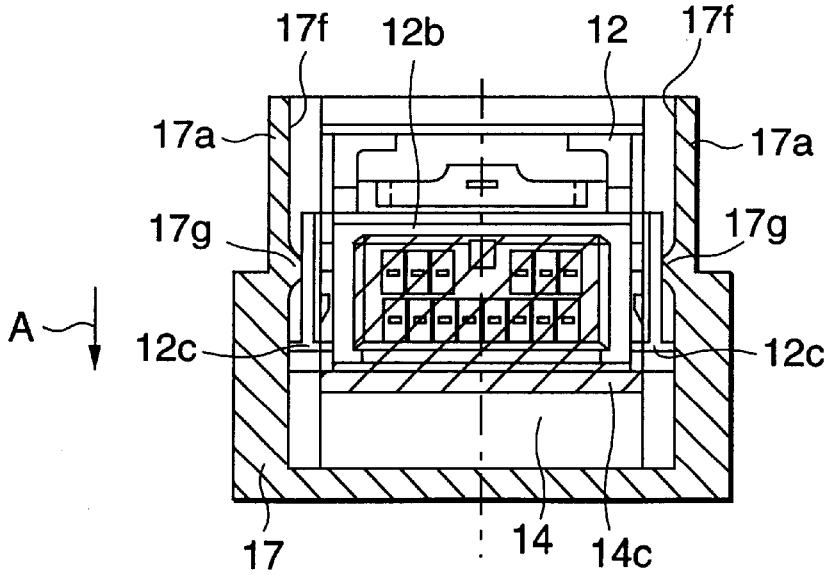
Figure 9:
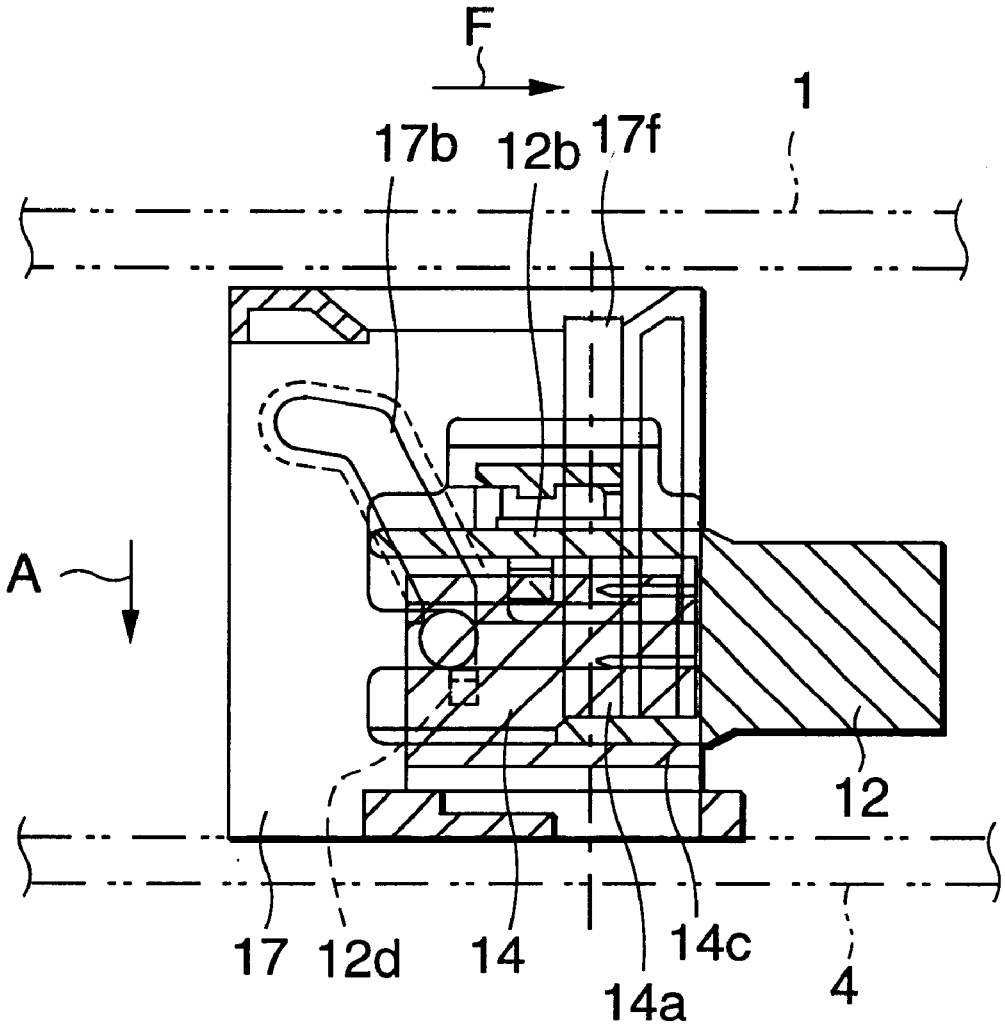
Figure 10A:
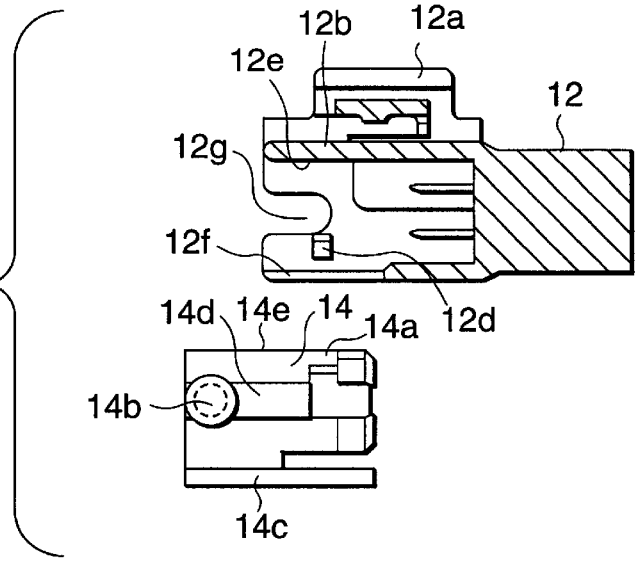
Figure 10B:
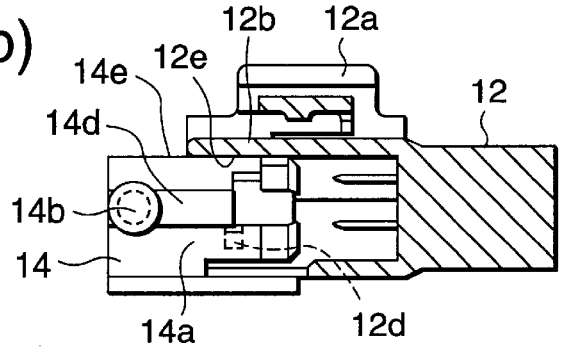
Figure 10C:
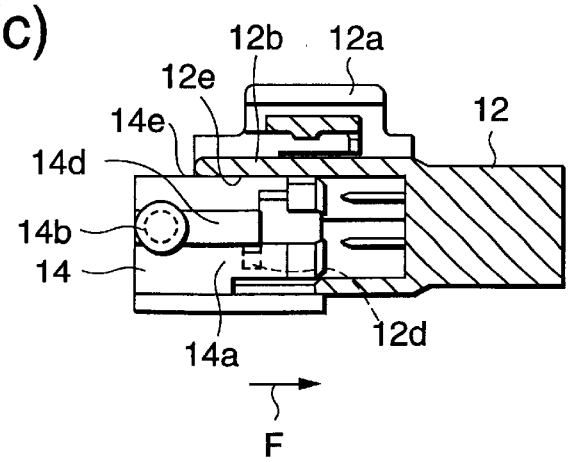
Figure 11:
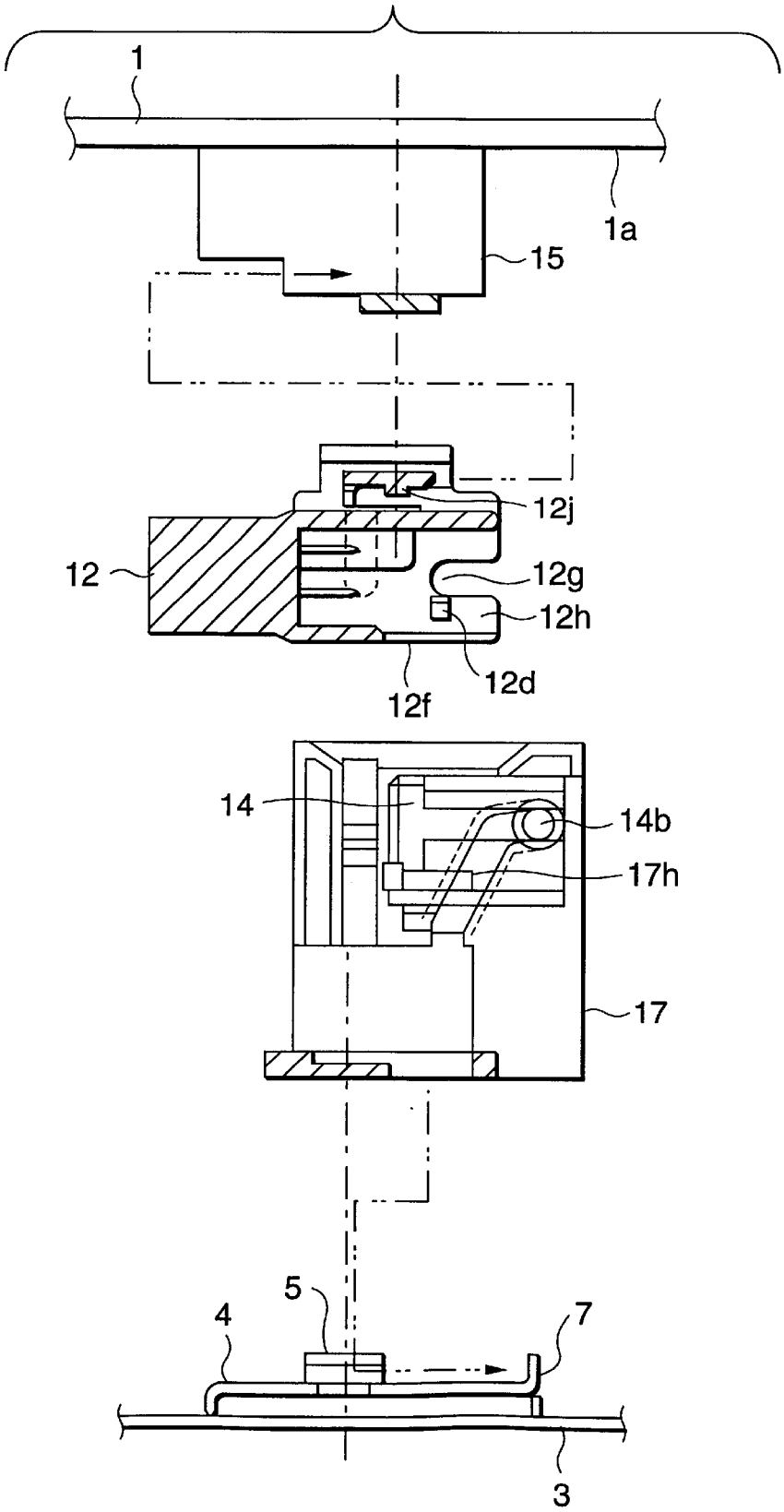
Figure 12A:
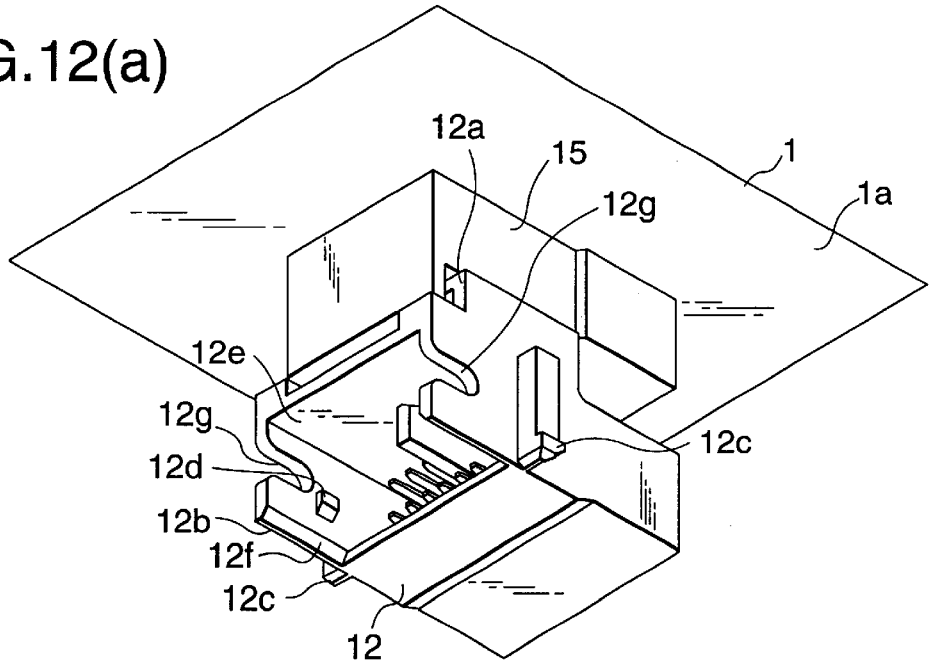
Figure 12B:
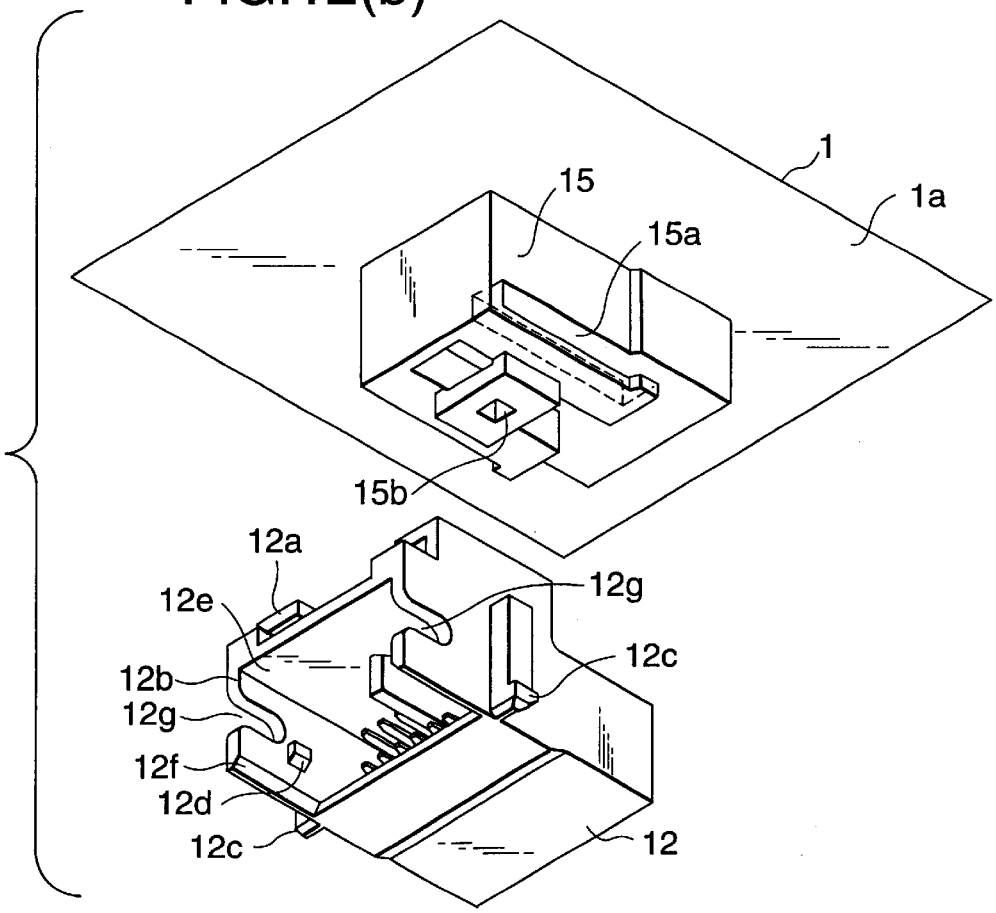
Figures 13A, 13B, 13C:
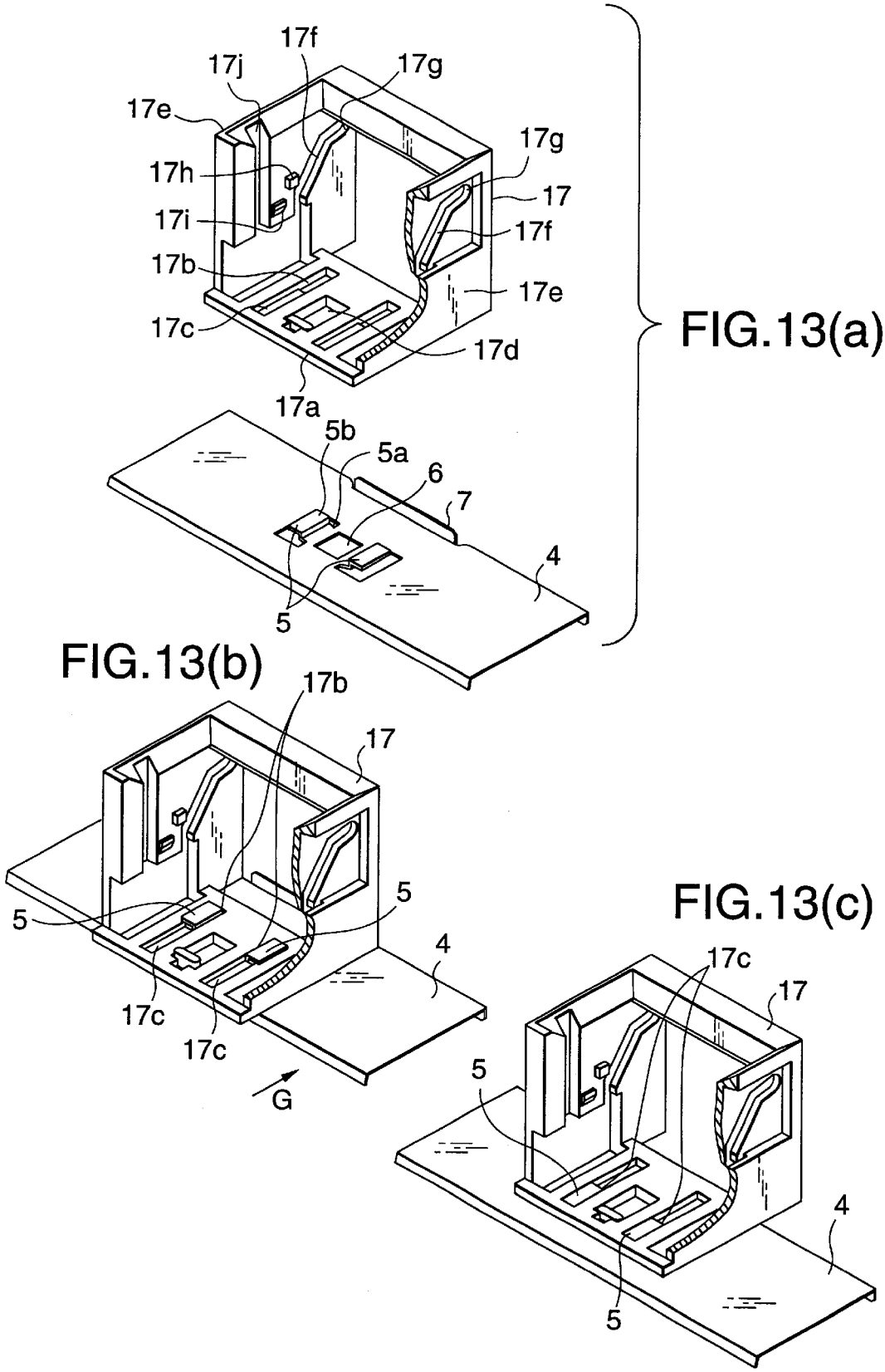
Figure 14A:
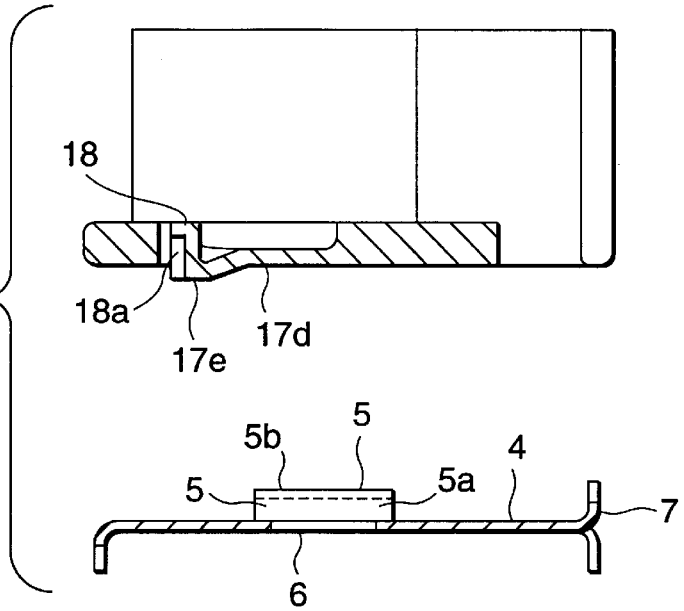
Figure 14B:
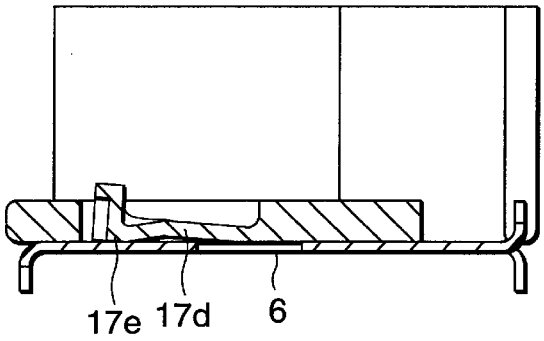
Figure 14C:
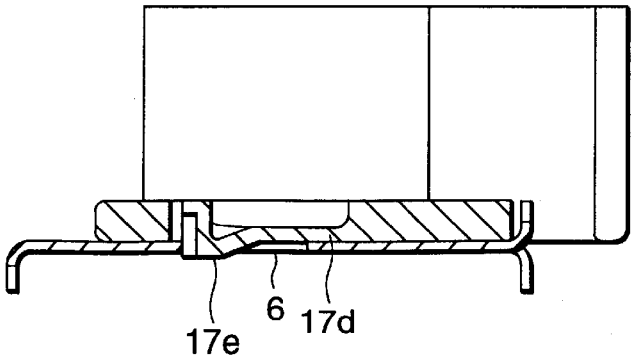
Figure 15:
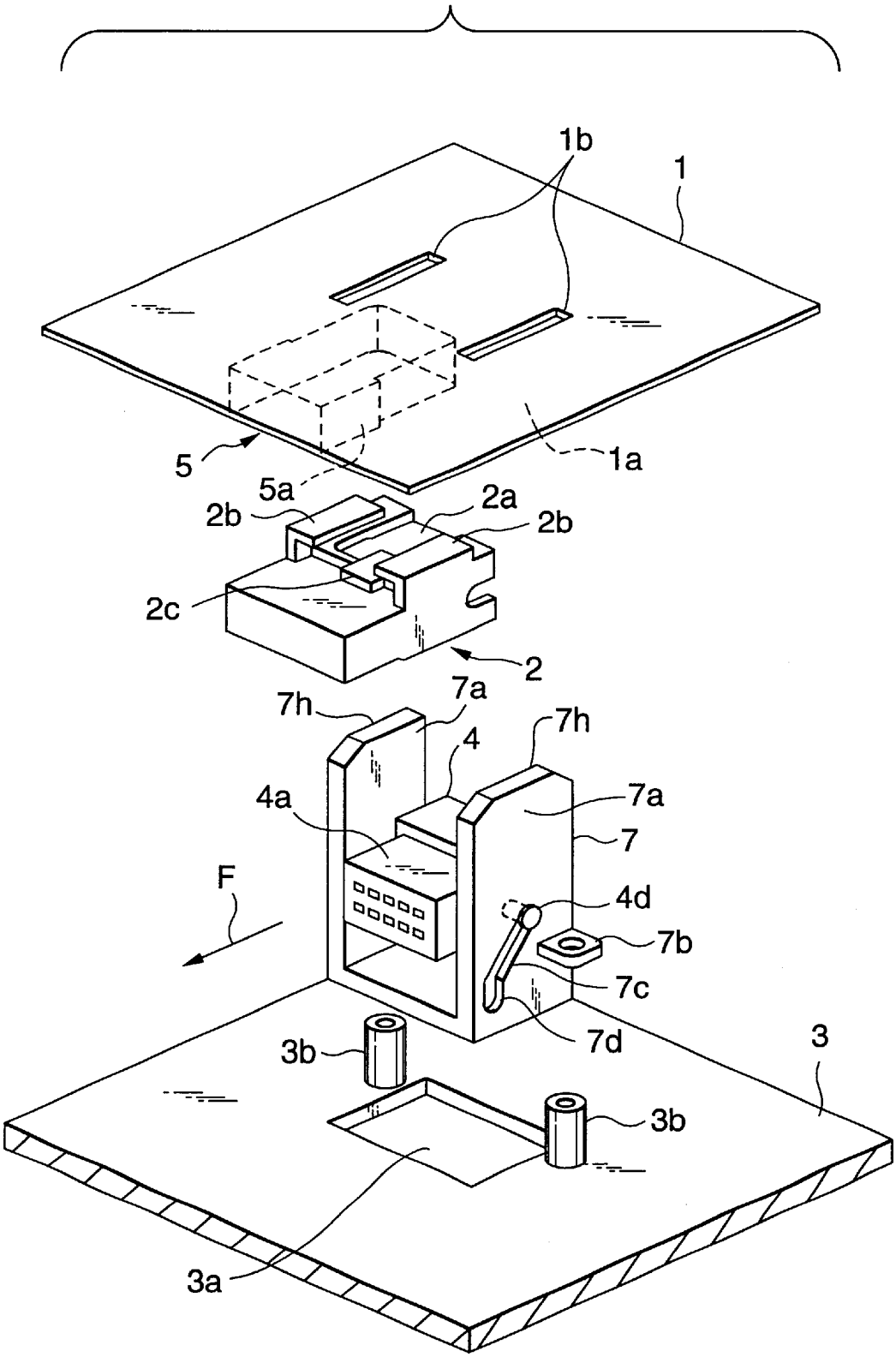
Figure 16A:
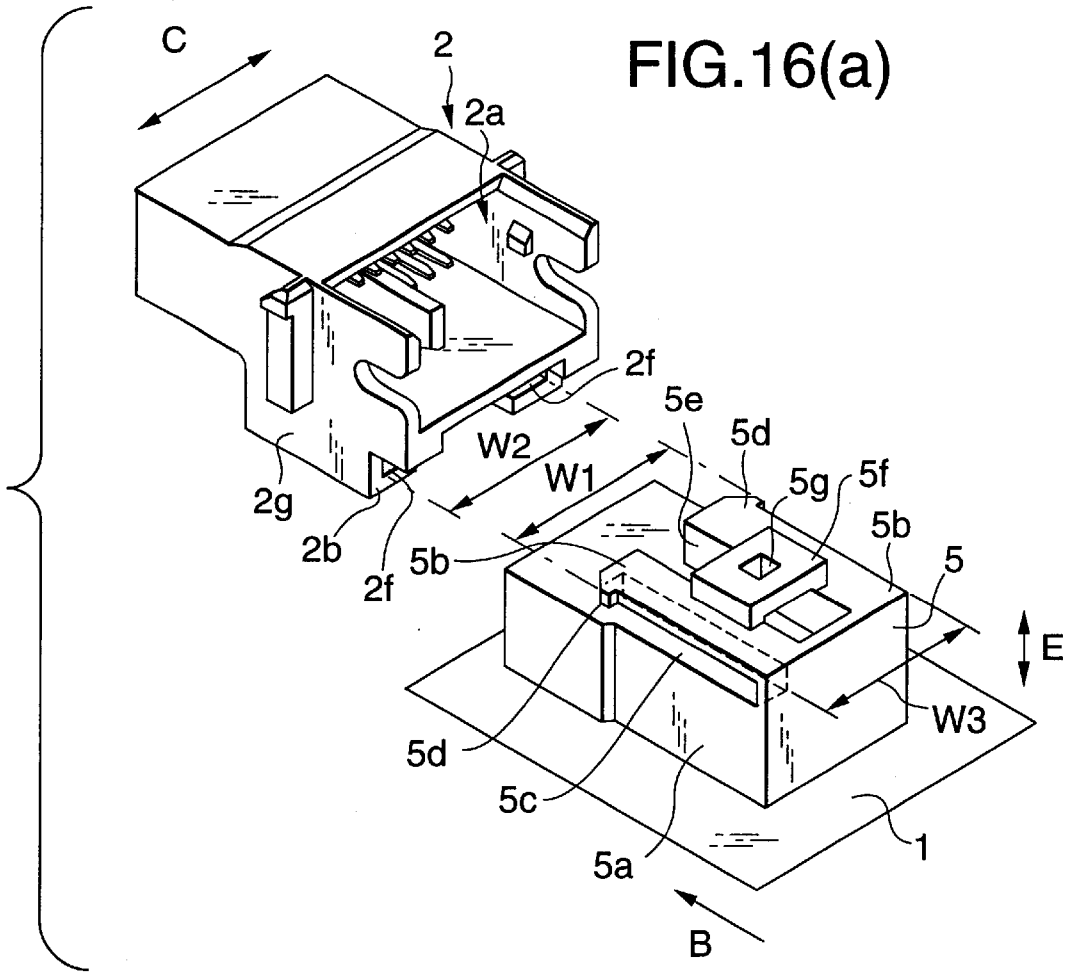
Figure 16B:
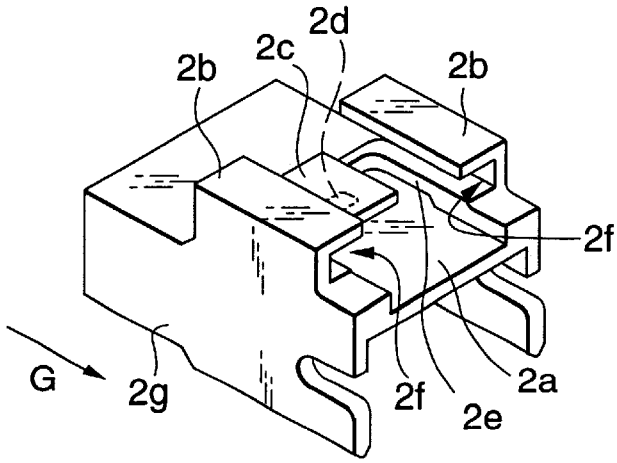
Figure 17A:
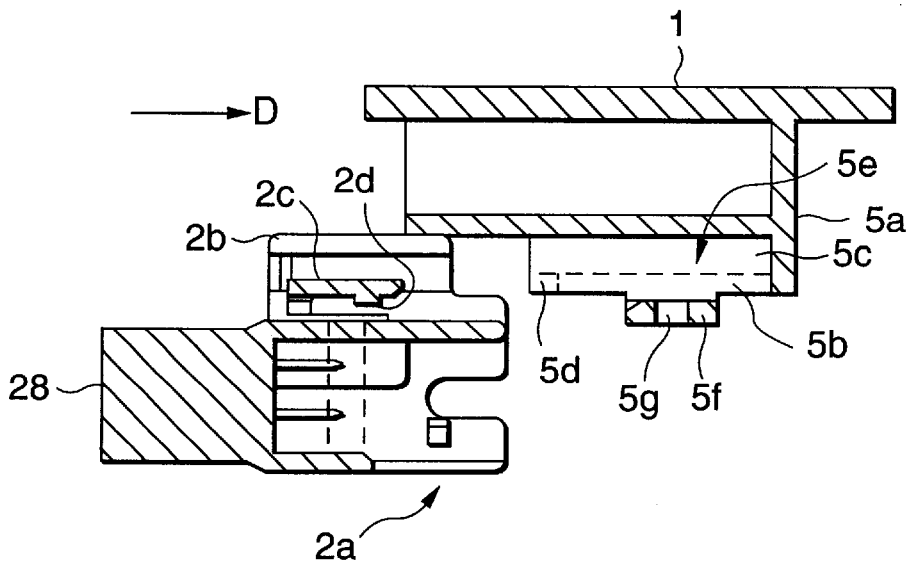
Figure 17B:
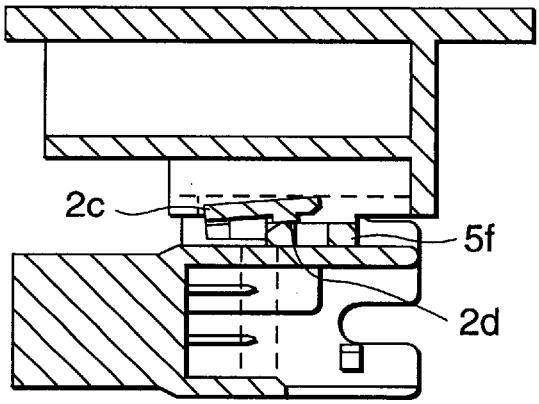
Figure 17C:
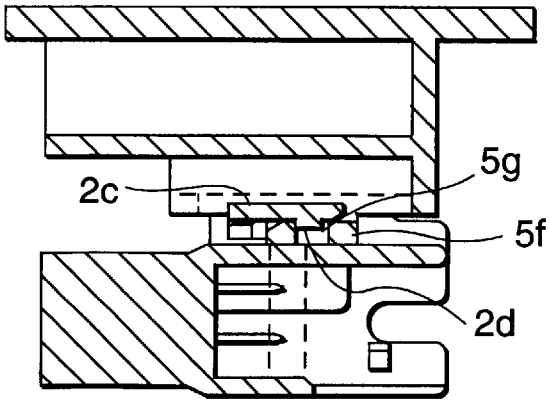
Figure 18A:
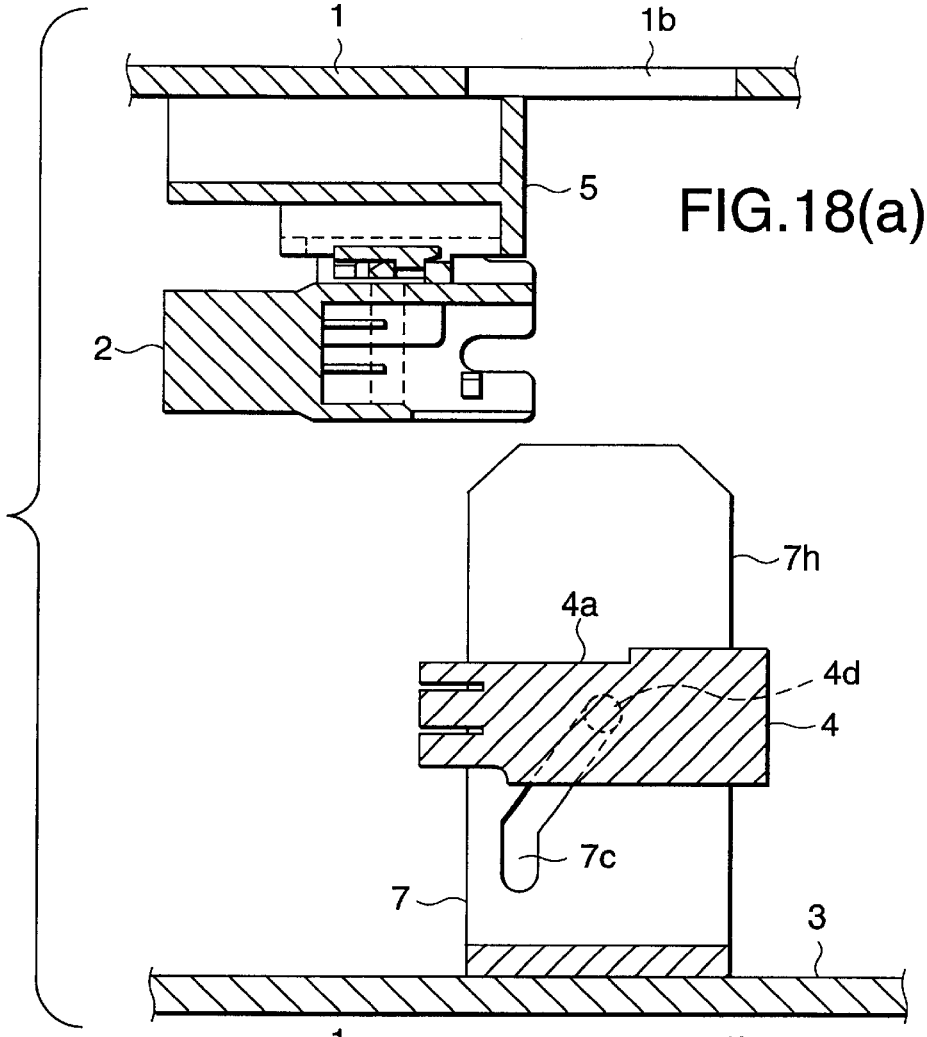
Figure 18B:
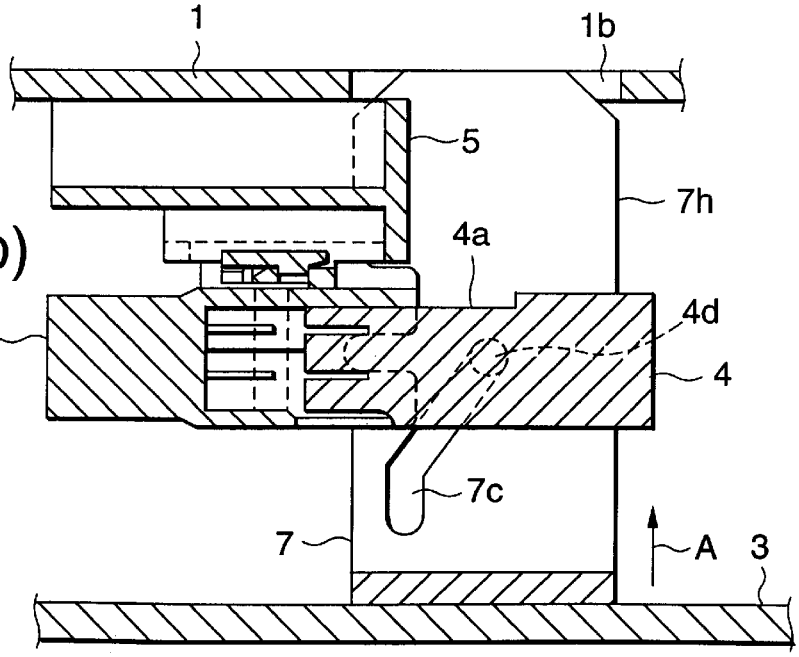
Figure 19A:
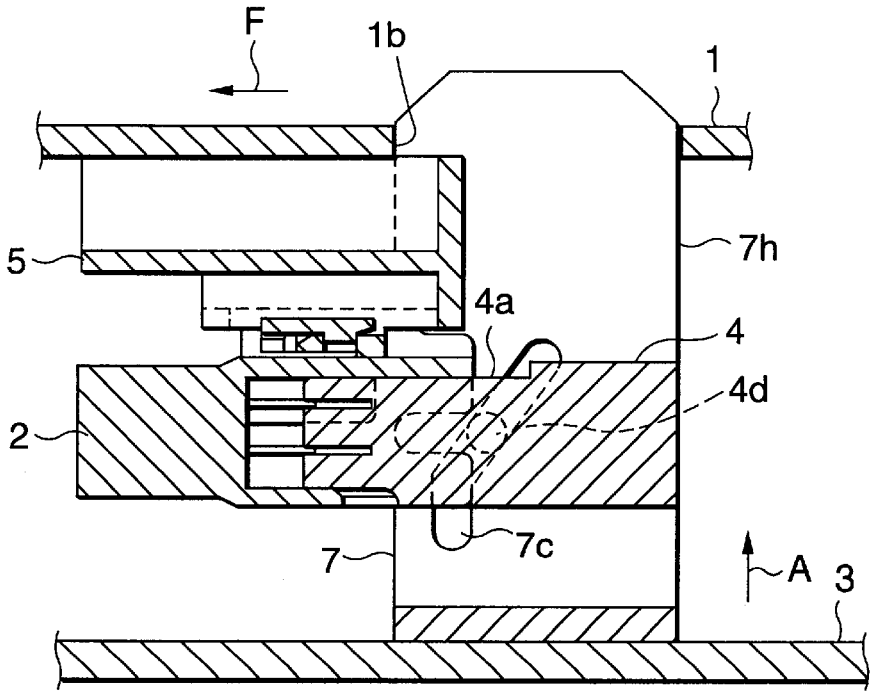
Figure 19B:
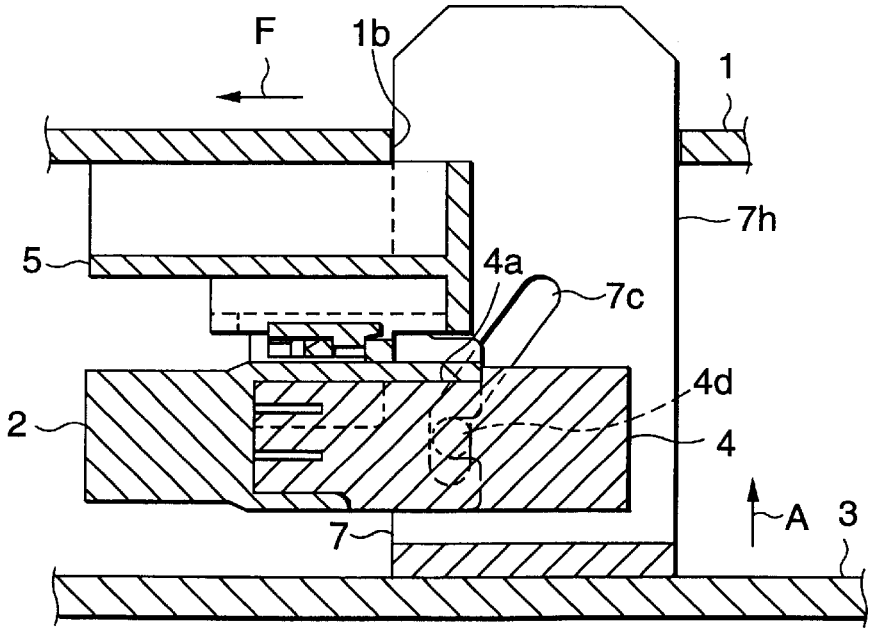
Figure 20A:
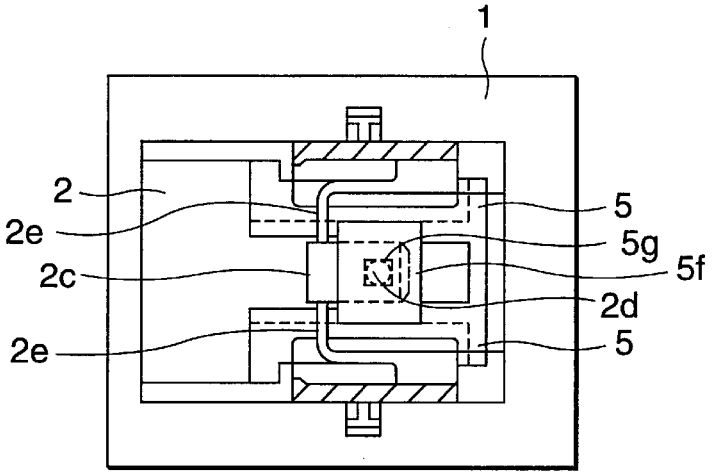
Figure 20B:
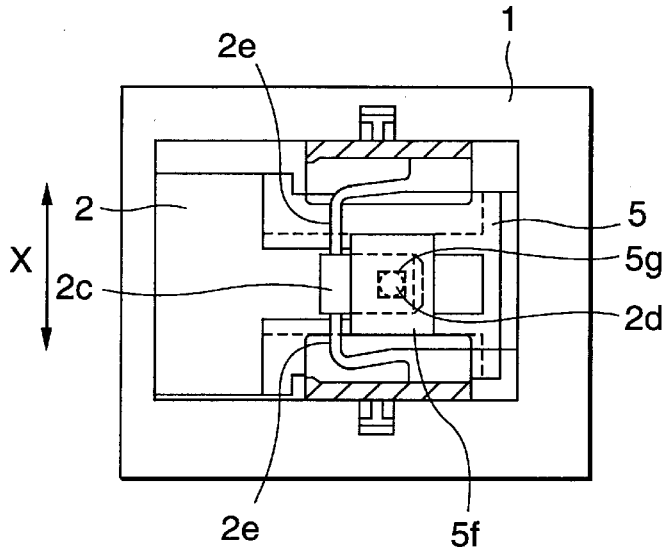
Figure 20C:
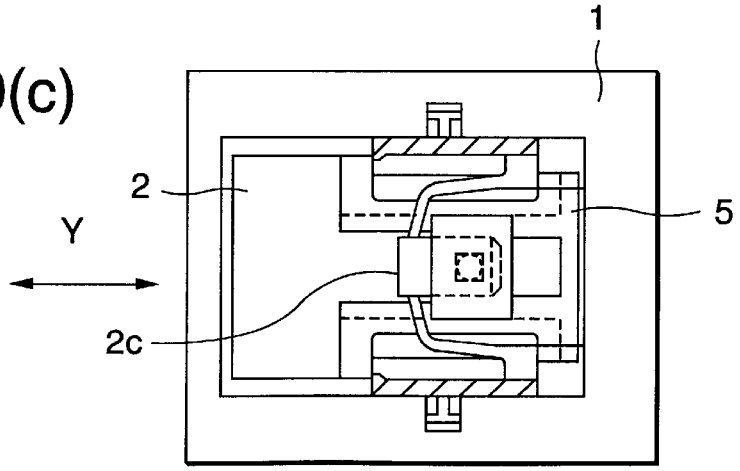
Figure 21:
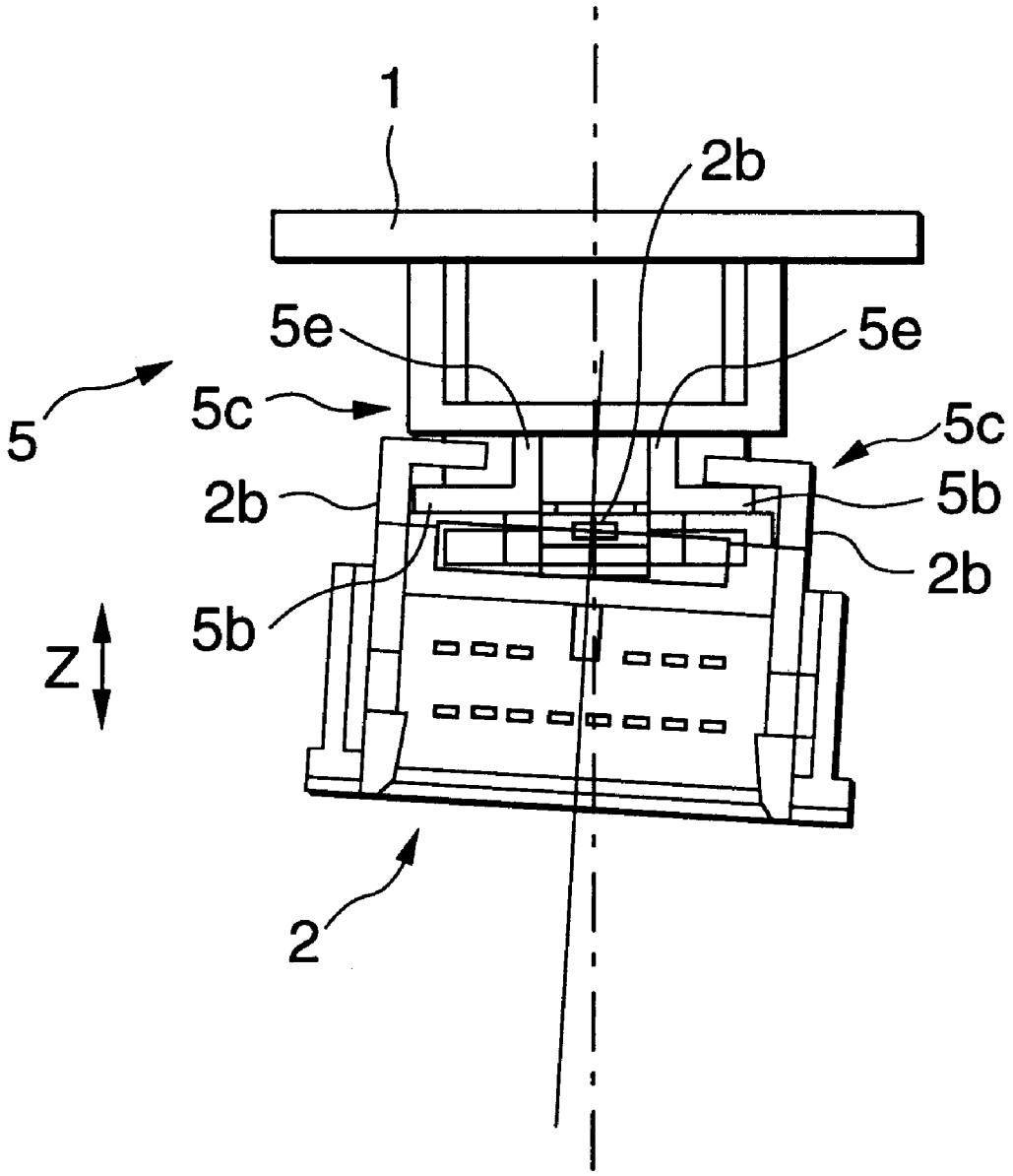

17f
17j
17g
17e
17g
17h
17
17i
17f
17b
17e
17c
17d
17a
5b
5a
6
7
4
5

17b
17
5
5
4
17c
17c
G 17c
17
5
4
5

CONNECTOR AND CONNECTOR ATTACHMENT STRUCTURE

BACKGROUND OF THE INVENTION

1. Field of the Invention

The present invention relates to a connector such as used in an automobile that is adapted to be connected together at the same time when a module side movable panel is attached to a vehicle body side fixed panel, and also relates to a connector attachment structure in which said connector can be attached to a corresponding connector even when there is caused a deviation in position between a vehicle body side fixed panel and a module side movable panel.

2. Description of the Related Art

Conventionally, in an assembling process of meter modules, door modules, overhead modules or the like, it is the practice to mount an electrical equipment module side panel (for instance, an instrument panel or an inner panel) on a vehicle body side panel (for instance, a dash panel, a door panel, or a roof panel) after a wiring harness connector of the former and a wiring harness connector of the latter are connected together with hands, this causing a problem that the assembling efficiency is deteriorated because the connectors have to manually be connected together. In addition, the wiring harness for each connector needs to have a certain extra length for such a manual connection of connectors, this constituting a cause for abnormal noises generated by running vibrations and producing a risk of an unnecessarily long electric wire being bitten by nearby components, and thus various types of countermeasures need to be taken thereagainst. Due to this, there is proposed a connector adapted to be connected together at the same time when a module side movable panel is attached to a vehicle body side fixed panel (refer to the official gazette of Japanese Unexamined Patent Publication (Kokai) No. Hei.5-54933).

In this proposed technology, a bracket having a fitting attachment port is attached, for instance, to a vehicle body side fixed panel, and the outside of a connector holder formed integral with a connector is supported with a plurality of elastic supporting pieces provided around the periphery of the fitting attachment port of the bracket. Then, another connector attached to a module side movable panel so as to correspond to that connector is connected to the corresponding connector. With this technology, even when there is caused a deviation in position between the vehicle body side fixed panel and the module side movable panel, the elastic supporting pieces are adapted to deflect to absorb such a deviation, the both connectors being thereby connected to each other.

In a conventional connector, however, a connector is only fixed on each panel in a longitudinal or antero-posterior direction, and therefore this causes a problem that a wide connector connecting space needs to be secured between the respective panels(in a depth-wise direction). To cope with the problem, there is conceived a connector in which a first connector is fixed to a first attachment member (module side movable panel) in a position where it is oriented transversely, while a second connector is supported on a holder for a second attachment member (vehicle body side fixed panel) in such a manner as to be displaced in a transversely oriented advancing direction, whereby the second connector is displaced in the transversely oriented advancing direction so at to eventually be connected with the first connector when the both attachment members are caused to relatively approach each other. In this connector, since the respective connectors are in a position they are oriented transversely before and after connection, there is no need to secure a wide connector connecting space between the respective attachment members (in a depth-wise direction), a connection of connectors thus being able to be effected even with a narrow depth-wise space. However, in order to put this connector to practical use, there remain several things to be improved for instance from an assembling point of view.

Furthermore, with the technology described above, in order to support the connector holder on the outside thereof by the elastic supporting pieces, for instance, in a case where the connector holder is rectangular, at least four elastic supporting pieces are needed, and in addition, the respective elastic pieces need to be brought into engagement with the connector holder, and this causes problems of a complicated structure and troublesome assembling work.

SUMMARY OF THE INVENTION

The present invention was made to solve the above problem inherent in the prior art and an object thereof is to provide a connector that can be connected together even in a space limited in the depth-wise direction. Additionally, the present invention is to provide a connector that can provide good assembling efficiency and be suitable for practical use.

Furthermore, the present invention is to provide a connector and a connector attachment structure that can facilitate an attachment of components through provision of a state in which a deviation in position is absorbed.

According to a first aspect of the present invention, the prevent invention provides a connector in which a first connector provided on a first attachment member and a second connector provided on a second attachment member are connected to each other when the both attachment members are caused to relatively approach each other, wherein the first connector is fixed on the first attachment member in a position where it is transversely oriented, while the second connector is supported on a holder fixed on the second attachment member in a position where it is transversely oriented in such a manner as to be displaced in a transversely oriented advancing direction, whereby the second connector is adapted to be displaced relative to said first connector in the transversely oriented advancing direction for connection with the first connector when the both attachment members are caused to relatively approach each other.

In the present invention, the second connector is displaced in the transversely oriented advancing direction for connection with the first connector by fixing the first connector to the first attachment member in a position where it is transversely oriented (oriented normal to a direction in which the attachment members are opposed to each other), supporting the second connector with the holder of the second attachment member in such a manner that the second connector is displaced in the transversely oriented advancing direction, and approaching the both attachment members to each other.

Therefore, since the both connectors remain in the transversely oriented positions before and after connection, there is no need to secure a wide connector connecting space between the respective attachment members (in the depth-wise direction), and therefore the connectors can be connected together even when the depth-wise space is limited or narrow.

Further, there is a feature that, it can be constructed such that guide pin portions of the second connector are fitted and supported in cam slot portions formed in the above holder in such a manner that the pin portions move in the transversely oriented advancing direction, that the second connector is moved in the transversely oriented direction by the cam slot portions when the both attachment members are caused to relatively approach each other, whereby the second connector is moved further in the transversely oriented advancing direction after the terminals of the first connector and the terminals of the second connector are completely fitted in each other.

With the above construction, when the both attachment members are caused to relatively approach each other, the second connector is moved toward the first connector in the transversely oriented advancing direction, and before they are completely connected each other the terminals of the first connector and the terminals of the second connector are completely fitted in each other. The first and second connectors are completely connected to each other thereafter. Thus, since the respective terminals are completely fitted in each other before the respective connectors are completely connected to each other, it is possible to absorb any dimensional error in attachment of the both attachment members in the depth-wise direction, enhancing the permissible dimensional tolerance for any error in the depth-wise direction. In addition, since the respective terminals are completely fitted in each other before the respective connectors are completely connected to each other, there is eliminated a risk of the connectors being fitted in each other only halfway (fitting failure). Moreover, since a force boosting action can be provided by forming the cam slot portions into a predetermined configuration, the connectors can be fitted in each other only with a reduced force.

Further, there is a feature that, it can be constructed such that a temporarily locking portion is provided on the holder for temporarily locking the second connector in a position where the connector is transversely oriented, and a temporary locking releasing portion is provided on the first connector for releasing the temporary locking provided by the above temporarily locking portion when the second connector comes to be opposed to the first connector.

With the above construction, since the second connector is temporarily locked at the transversely oriented initial position by the temporarily locking portions of the holder before it is connected to the first connector, it is possible to prevent the second connector from being moved from the transversely oriented initial position by an abrupt external force and also possible to fit and connect the respective connectors in a smooth fashion.

Further, there is a feature that, it can be constructed such that a holding and guiding portion is provided on the first connector for holding the second connector at an opposed position when the second connector comes to be opposed to the first connector and guiding it for a movement in the transversely oriented advancing direction.

With the above construction, since the second connector is held by the holding and guide portions of the first connector and is guided for the transversely oriented advancing direction before it comes to be connected to the first connector, there is eliminated a drawback that the second connector is fitted in the first connector in an inclined fashion as it is so inclined, thereby making it possible to fit and connect the respective connectors in a smooth fashion, the reliability in fitting and connecting being thus enhanced.

Further, there is a feature that, it can be constructed such that a positioning portion is formed on the holder for engagement with a positioning hole formed in the first connector when the first and second connectors are coupled together.

With the above construction, since the relative position between the first and second connectors is automatically determined when the both attachment members are caused to relatively approach each other, the respective connectors can be fitted in and connected to each other in a smooth fashion.

Further, there is a feature that, as to the function of the first attachment member and the second attachment member, one of the two attachment members is adapted to function as a vehicle body side fixed panel of an automobile and the other as an electrical equipment module movable panel thereof, whereby no operation of manually connecting connectors is required in automobile assembling processes.

With the above construction, since no manual connector connecting operation is required during automobile assembling processes, this enables the automated assembling of components involved, improving the assembling efficiency. In addition, since there is eliminated a risk of a wiring harness of a certain extra length generating abnormal noises from running vibrations or an unnecessarily long electric wire being bitten by nearby components, there is no need to take various types of countermeasures against such a risk. In addition, there is no need to secure a wide space between the vehicle body side panel and the electric equipment module side panel in the depth-wise direction, the passenger compartment can be extended to such an extent that the depth-wise space could be saved in the aforementioned manner.

In order to solve the above problem, according to a second aspect of the present invention, there is a feature that, the prevent invention provides a connector in which a first connector is fixed to a first attachment member in a position where the first connector is oriented transversely, and in which a second connector is supported on a holder fixed to a second attachment member opposed to the first attachment member in such a manner that the second connector is displaced in a transversely oriented advancing direction while held in a position where the second connector is oriented transversely, whereby the second connector is adapted to be moved in the transversely oriented advancing direction relative to the first connector to eventually be connected with the first connector when the both attachment members are caused to relatively approach each other, wherein an interlocking portion and a portion to be interlocked are relatively provided on the second attachment member and the holder, respectively, in such a manner as to be brought into engagement with each other when the holder is caused to slide in a direction along the second attachment member, and in that a locking portion and a portion to be locked are relatively provided on the second attachment member and the holder, respectively, in such a manner as to be brought into engagement with each other for stopping the movement of the holder when the second attachment member and the holder are in engagement with each other.

As is clear from the above descriptions, with the connector according to a first aspect of the present invention, when the holder is caused to slide in a direction along the second attachment member, the interlocking portion is brought into engagement with the portion to be interlocked, and the locking portion is also brought into engagement with the portion to be locked, whereby the holder can be fixed to the second attachment member with a single action, thus making it possible to improve the efficiency of assembling work. In addition, with the first connector being fixed to the first attachment member in a position where it is oriented transversely and the second connector being supported on the holder for the second attachment member in such a manner as to be displaced in the transversely oriented advancing direction, when the both attachment members are caused to relatively approach each other, the second connector is displaced in the transversely oriented advancing direction to eventually be connected with the first connector. Thus, since the respective connectors remain in positions where they are oriented transversely before and after connection, there is no need to secure a wide connector connecting space between the respective attachment members (in a depth-wise direction), a connection of the connectors thus being able to be effected even with a space limited in the depth-wise direction. Moreover, with the construction in which a wiring harness is connected to the second connector, the second connector to which the wiring harness is so connected is then assembled to the holder, and the holder to which the second connector is so assembled is then fixed to the second attachment member, the extra length for the wiring harness can be made shorter when compared with a construction in which the holder is fixed to the second attachment member, and the second connector to which the wiring harness is already connected is then assembled to the holder fixed to the second attachment member, thus making it possible to reduce not only the material cost but also a risk, attributed to a longer extra length, of abnormal noises being generated and an unnecessarily long electric wire being bitten by nearby components.

In the connector according to the present invention, the interlocking portion is constituted by a hook and the portion to be interlocked by a hook insertion hole and a hook locking piece.

In this structure, when the interlocking portion constituted by the hook is inserted in the hook insertion hole acting as the portion to be interlocked and is then caused to slide, the hook becomes connected to the hook locking piece. This construction is advantageous when the interlocking portion comprising the hook and the portion to be interlocked constructed so as to have the hook insertion hole other than the hook locking piece are disposed at a central portion on either the second attachment member or the holder whichever suitable. In other words, in a case where the hook as the interlocking portion and the hook locking piece as the portion to be interlocked, namely, the hook locking piece having a hole omitted therefrom, are disposed at an end of the member or the holder, the sliding distance may be short, but in a case where they are disposed at a central portion to improve the attachment condition in which the holder is attached to the second attachment member, the hook locking portion needs to be elongated so as to secure a longer sliding distance. In addition, the degree of freedom of a peripheral mechanism for effecting such sliding is limited. Furthermore, in a case where the portion to be interlocked has the hook insertion hole on top of the hook locking piece, the hook only has to be tried to be inserted in the hook insertion hole so as to slide therein, this facilitating the locking of the hook, thus this being advantageous in that the workability can be improved.

In the connector according to the present invention, a lock releasing means for releasing the aforementioned stopped movement may be provided on at least one of the locking portion and the portion to be locked.

With the above construction, having the lock releasing means, it is possible to separate easily the second attachment member and the holder which are in engagement with each other.

In a case where this construction is adopted, when the lock releasing means is operated so as to release an engagement state between the second attachment member and the holder, in other words, a locked state, the relatively stopped movement between the second attachment member and the holder is released, whereby they can be separated from each other.

In the connector according to the present invention, a reverse attachment detecting means is provided on at least one of the second attachment member and the holder for regulating the relative attachment of the second attachment member to the holder against an attachment in a reverse direction.

With the above construction, having the reverse attachment detecting means, the holder can be attached to the second attachment member only in a predetermined direction all the time, and therefore it is convenient when there is required a certain direction for the engagement of the interlocking portions and the portions to be interlocked.

In this construction, in a case where the second attachment member or the holder is tried to be attached to the other in a direction reverse to a predetermined direction in which both of them are to be attached to each other, since the reverse attachment detecting means informs the operator of a reverse attachment, the holder can be attached to the second attachment member only in a predetermined direction, and this is effective when the locking portion and the portion to be locked are to be attached to each other only in a predetermined direction.

With the above construction, in which one of the first and second attachment members functions as a vehicle body side fixed panel of an automobile, while the other as an electrical equipment module side movable panel thereof, automated assembling of components can be provided and this improves the efficiency of assembling work and eliminates a risk associated with a longer extra length for the wiring harness of abnormal noises being generated or an unnecessarily long electric wire being bitten by nearby components, thus obviating the necessity of taking countermeasures against such a risk. In addition, there is no need to secure a wide space in the depth-wise direction between the vehicle side panel and the electric equipment module side panel, thus making it possible to extend the length of the passenger compartment to such an extent that the depth-wise space is reduced.

In order to attain the above object, according to a third aspect of the present invention, there is a feature that, the present invention provides a connector having a portion to be locked adapted to be locked in a locking portion provided at an attaching position, wherein a corresponding connector is electrically connected in a state in which the portion to be locked is locked in the locking portion, the connector being characterized in that a housing therefor and the portion to be locked are connected integrally in such a manner that they can be displaced relative to each other.

Further, it is preferable to have a connecting piece for connecting the housing with the portion to be locked, the connecting piece being formed so thin that it deflects.

As is described in detail, since the portion to be locked can be displaced relative to the housing, the connector can be displaced relative to the locking portion or the portion to be locked even in a state in which the portion to be locked is locked in the locking portion, whereby the connector can easily be attached to a predetermined position in a state in which a deviation is absorbed. In addition, since the portion to be locked is formed integrally with the housing, a simple structure can be provided.

A connector attachment structure according to the present invention comprises a connector as set forth the above and a holder having a locking portion for locking the portion to be locked of the connector and is constructed such that the relative position of the connector to said holder can be changed in a state in which the portion to be locked is locked in the locking portion.

In the connector attachment structure according to the present invention, a corresponding connector provided on the panel is attached to the connector attached to the holder. At this time, the holder is attached to the panel different from that to which the corresponding connector is attached, and if it happens that the both panels are attached to positions that are deviated from predetermined positions, there is caused a similar deviation between the corresponding connector and the connector of the present invention. In a state like this, when the both connectors are connected to each other, there is then caused a similar deviation between the connector and the holder.

Furthermore, since the connector position can be shifted relative to the holder, even when there is caused a deviation in position between the holder and the connector, a deviation so caused can be absorbed through the shift in position of the connector. According to the connector attachment structure of the present invention, the change in relative position of the connector to the holder is regulated within a certain range.

With this structure adopted, the connector is only allowed to change its relative position to the holder and therefore the connector is prevented from changing its position so extraordinarily greatly that it goes beyond the range so regulated.

It is preferable to have as a structure to cope with the above a construction wherein a slide guiding piece is provided on one of the connector and the holder and wherein a guide groove for guiding the slide guide piece is formed in the other so that the slide guide piece can be displaced within the guide groove.

Furthermore, it is preferable to have a structure, that is, a connector attachment structure according to claim 5, wherein a displacement regulating portion is provided for regulating a displacement of the connector in a siding direction.

In addition, with the above mentioned invention, since the deviation in position of the connector relative to the holder can be regulated, failures of the holders, connectors or connecting piece can be prevented which would otherwise be caused when the connectors are attached or removed in order to cope with a larger deviation.

What is claimed is:

1. A connector between a first attachment member and second attachment member, comprising:

a first connection portion, fixed to the first attachment member, slidable in a first direction; and a holder fixed on the second attachment member;

a second connection portion, supported by the holder, slideable in a second direction which is different than the first direction, wherein said second connection portion is advanced in the second direction so as to connect with said first connection portion when said first attachment member and second attachment member are relatively approached from a third direction different than the first and second directions.

2. The connector as claimed in claim 1, wherein said first connection portion includes a holding and guiding portion for holding said second connection portion at an opposed position and for guiding said second connection portion toward said first connection portion in the second direction.

3. The connector as claimed in claim 1, wherein said holder included a positioning portion which is engaged with a positioning hole formed on said first attachment member when said first connection portion and second connection portion are completely connected with each other.

4. The connector as claimed in claim 1, wherein said one of first attachment member and said second attachment member is constructed to function as a vehicle body side fixed panel of an automobile and the other as an electrical equipment module movable panel.

5. The connector as claimed in claim 1, wherein the second connection portion includes guide pins at side faces, and said second attachment member has cam slot portions into which said glide pins are fitted and when said first and second attachment members are relatively approached from the third direction which is different than the first and second directions, said second connection portion is guided in the second direction along said cam slot portions.

6. The connector as claimed in claim 5, wherein said holder further comprises a temporarily locking portion for temporarily locking said second connection portion at an initial position, and said first connection portion further comprises a temporary locking releasing portion for releasing the temporary locking of the second connection portion.

7. The connector as claimed in claim 1, wherein said first connection portion includes a mounting portion to be fixed with a locking portion on said first attachment member, said mounting portion is movably and integrally formed in a connector housing of said first connection portion.

8. The connector as claimed in claim 7, wherein said first connection portion has a flexible connecting piece for flexibly connecting said connector housing and said mounting portion.

9. The connector as claimed in claim 1, wherein said holder is fixed on said second attachment member by an interlocking portion and a portion to be interlocked in such a manner as to be brought into engagement with each other when said holder is slid in the first direction, and a lock member is provided to stop the sliding of said holder when said holder is engaged with said second attachment member.

10. The connector as claimed in claim 9, wherein said interlocking portion is constituted by a hook and said portion to be interlocked is constituted by a hook insertion hole and a hook locking piece.

11. The connector as claimed in claim 9, wherein lock releasing means for releasing said stopped movement is provided on at least one of said locking portion and said portion to be locked.

12. The connector as claimed in claim 9, wherein a detachment detecting means is provided on at least one of said second attachment member and said holder for regulating the relative attachment of said second attachment member and said holder against detachment.

13. A connector, comprising:

a first connection portion having a locking portion;

a housing for the locking portion fixed on a first attachment member, wherein the first connection portion and the locking portion can be displaced in a first direction relative to the housing when the locking portion is locked; and a second connection portion, attached to a second attachment member, wherein the second connection member is advanced in a second direction so as to connect to the first attachment member and the first connection portion is electrically connected with the second connection portion when the first attachment member and the second attachment member approach each other from a third direction different than the first and second directions; and a holder for the second connection portion having a second locking portion constructed such that a relative position of the first connection portion to said holder can be changed in a state in which said first locking portion is locked to said housing in said locking position.

14. The connector as claimed in claim 13, further comprising a connecting piece for connecting said housing and said locking portion, said connecting piece being formed so thin that it deflects.

15. A connector attachment structure comprising:

a first connection portion having a locking portion provided at an attaching position, wherein the first connection portion is electrically connected to a second connection portion in a state in which the locking portion is locked;

a housing for the locking portion, wherein the first connection portion and the locking portion can be displaced relative to the housing when the locking portion is locked; and a holder for the second connection portion having a second locking portion constructed such that the relative position of the first connection portion to said holder can be changed in a state in which said second locking portion is locked in said locking position.

16. The connector attachment structure as set forth in claim 15, wherein said change in relative position of said connector to said holder is regulated within a certain range.

17. The connector attachment structure as claimed in claim 16, further comprising:

a slide guiding piece on one of said connector and said holder; and a guide groove for guiding said slide guide piece is formed in the other one of said connector and said holder, wherein said slide guide piece can be displaced within said guide groove.

18. The connector attachment structure as claimed in claim 17, further comprising a displacement regulating portion for regulating a displacement of said connector in a displacing direction.

* * * * *